US006520080B1

(12) United States Patent
Fried

(10) Patent No.: US 6,520,080 B1
(45) Date of Patent: Feb. 18, 2003

(54) SYSTEM AND METHOD FOR UTILIZING WEB FROM A ROLL HAVING SPLICES

(75) Inventor: Jules M. Fried, Brookline, MA (US)

(73) Assignee: Roll Systems, Inc., Burlington, MA (US)

( * ) Notice: Subject to any disclaimer, the term of this patent is extended or adjusted under 35 U.S.C. 154(b) by 176 days.

(21) Appl. No.: 09/738,582

(22) Filed: Dec. 15, 2000

(51) Int. Cl.[7] ..... B41F 13/56
(52) U.S. Cl. ..... 101/227; 101/484
(58) Field of Search ..... 101/227, 484

(56) References Cited

U.S. PATENT DOCUMENTS 4,893,763 A 1/1990 Wales et al.
4,901,577 A * 2/1990 Roberts ..... 73/600
5,000,394 A 3/1991 Wales et al.
5,280,903 A 1/1994 Herrick, Jr.
5,284,335 A 2/1994 Golicz
5,344,057 A 9/1994 Crowley
5,344,089 A * 9/1994 Crowley et al. ..... 242/417
5,366,212 A 11/1994 Crowley et al.
5,494,272 A 2/1996 Golicz
5,538,171 A 7/1996 Crowley
5,628,574 A 5/1997 Crowley
5,692,746 A 12/1997 Herrick, Jr.
5,751,298 A 5/1998 Crowley
5,967,394 A 10/1999 Crowley et al.
6,112,658 A * 9/2000 Gunther et al. ..... 101/171

* cited by examiner

*Primary Examiner*—Andrew H. Hirshfeld
*Assistant Examiner*—Charles H. Nolan, Jr.
(74) *Attorney, Agent, or Firm*—William A. Loginov; Cesari and McKenna, LLP

(57) ABSTRACT

A system and method for detecting and diverting sections of web having splices on a continuous web is provided. A splice detector is located adjacent a source of continuous web, typically a roll. The movement of the web from the roll is tracked, and the relative location of the splice within the web stream is noted by a controller. Downstream, a web utilization device is provided with a movement detector also connected to the controller. Movement of the splice-containing section through utilization device is tracked so that the splice-containing section is not processed by the utilization device, or is reprocessed on a non-splice-containing section. A cutter is also provided with a movement detector, also connected to the controller. Movement of the web from the utilization device to the cutter is tracked and the section containing the web is cut. A diversion mechanism can be used to remove the cut section of web containing the splice so that it does not appear in the final stream of finished cut sheets.

18 Claims, 6 Drawing Sheets

SYSTEM AND METHOD FOR UTILIZING WEB FROM A ROLL HAVING SPLICES

BACKGROUND OF THE INVENTION

1. Field of the Invention

This invention relates to web handling systems and methods and more particularly to web inspection and removal of unwanted web sections.

2. Background Information

In continuous web printing and handling operations, a web that is typically composed of paper, is driven on a large roll through a succession of web utilization devices. In general, these devices include one or more printers, and associated cutters, stackers, binders—and a large variety of other web utilization/enhancement devices. It is common for long runs of web wound on a roll to include several splices within the overall stream. A splice is where two discrete ends of continuous web are joined together, typically in an overlapping relation using adhesive, tape or another joining mechanism. It is generally undesirable to process printing or other operations on a splice section. The resulting cut sheet exhibits generally inferior and unacceptable quality.

One commonly employed technique for dealing with splices is to visually scan the web as it passed through a given point in the process stream, and attempt to identify/flag a found splice section. If possible, the flagged splice is manually removed from the web, or from the resulting stream of sheets. Alternatively, the printing is adjusted to avoid the splice section. If the splice is not detected sufficiently early (before any printing or post-production operations have occurred on the web), and then it may become incorporated into a page in the overall print job. As such, it would be necessary to reprint and re-sort the splice-containing page, or to discard the entire job section containing the splice page. Each of these outcomes expends valuable production time and/or resources.

Commonly assigned U.S. Pat. No. 5,628,574, entitled WEB ERROR RECOVERY DIVERT SYSTEM by H. W. Crowley teaches a technique for diverting sheets containing errors therein from an overall web processing job. The teachings of this patent are expressly incorporated herein by reference. It should be possible, based upon the ability to divert errors, to remove unwanted splice sections from a web.

Accordingly, it is an object of this invention to provide a system and method for detecting and removing web sections having splices without affecting the overall flow and makeup of a web processing job.

SUMMARY OF THE INVENTION

This invention overcomes the disadvantages of the prior art by providing a system and method for detecting and removing splice sections from a continuous web in a web processing job that detects a splice, identifies/flags a selected length containing the splice, stores or otherwise records the splice position in the web stream, tracks the length to an appropriate divert location and, whence removes the affected section (or otherwise marks it as erroneous/undesired).

In a preferred embodiment, a detector is positioned adjacent a feed location for the continuous web, upstream of a printer or other web processing device. A tracking mechanism such as a mark detector determines the associated location of a splice and maintains, using a controller having a shift register, counter or other tracking device, information on the relative position of the splice section in the stream. If the downstream device is a printer, another tracking mechanism within the printer determines when the splice section is presented to the print engine, and omits printing from this identified splice section. If the downstream device is a cutter, then the cutter, using a web movement tracking mechanism, determines when the splice section is presented, and cuts the splice section for subsequent removal from the stream. In particular, where printing is omitted from a section, and a further downstream cutter is provided, the cutter, using the movement tracking mechanism, cuts the non-printed spliced section for subsequent removal. Removal of the splice-containing section can involve a divert gate that opens when the cut splice section is adjacent thereto and then again closes to enable further sheets to pass there along. In general, the remaining sheets in the stream are unaffected by the diverted splicer sheet as it is removed before final binding or other grouping of sheets occurs, and the order of sheets, with the splice-containing sheet removed is unchanged.

BRIEF DESCRIPTION OF THE DRAWINGS

The foregoing and other objects and advantages of the invention will become clearer with reference to the following detailed description as illustrated by the drawings in which.

DETAILED DESCRIPTION OF AN ILLUSTRATIVE EMBODIMENT

Figure 1:
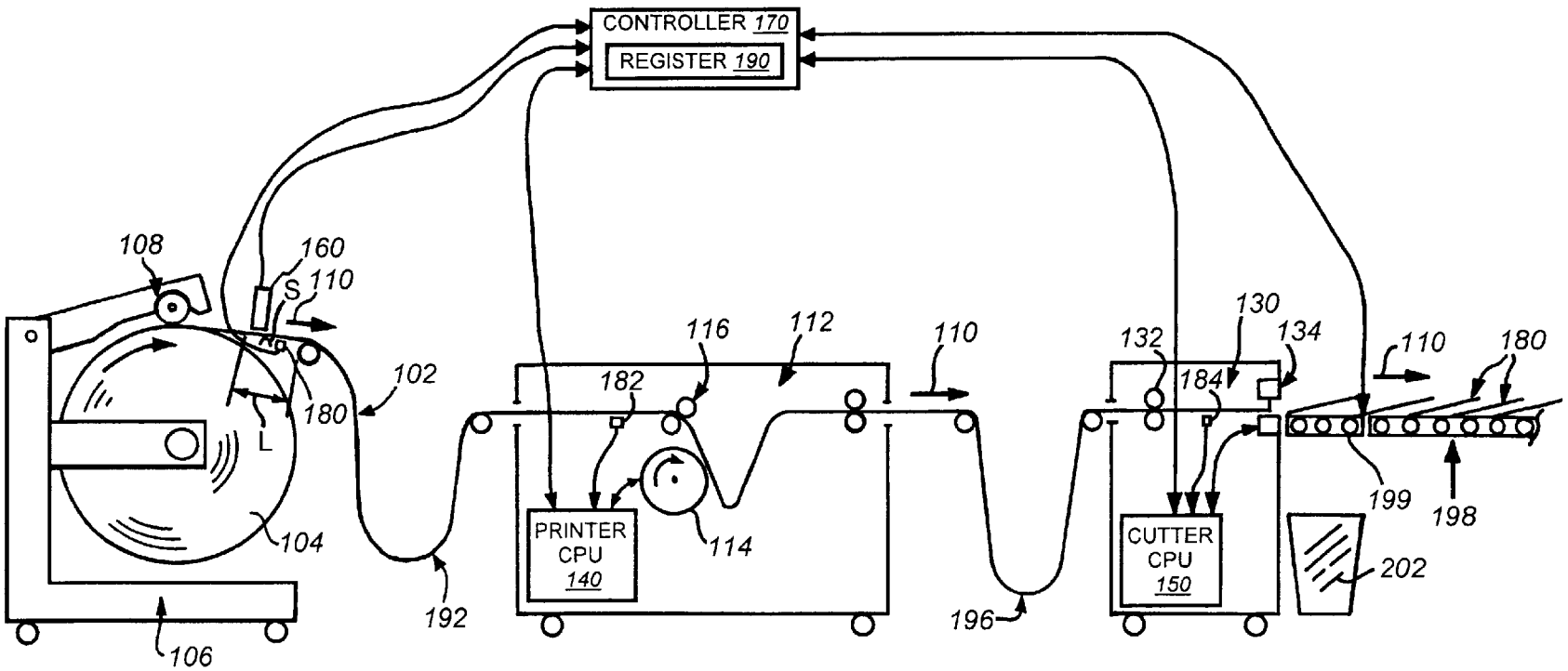
FIG. 1 is a schematic side view of a web processing system including a splice detection and diversion mechanism according to an embodiment of this invention, in which a splice is located at the detection location.
Figure 4:
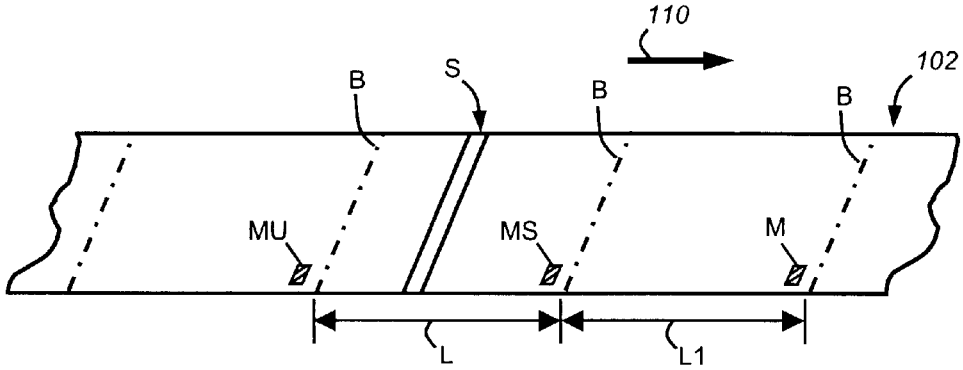
FIG. 4 is a schematic perspective view of a continuous web having a series of sections including a splice-containing section.

FIG. 1 shows a web processing system that includes a system for detecting and diverting splice sections according to a preferred embodiment of this invention. A continuous web 102 is fed from a roll 104 mounted on a roll stand 106. The roll stand is driven by a drive member 108. An exemplary roll stand is shown and described in commonly owned U.S. Pat. No. 4,893,763, entitled ROLL SUPPORT AND FEED APPARATUS, by H. W. Crowley, et al. Typically, such rolls (104) are several feet in diameter and can weigh 600 pounds or more. The web 102 is driven generally in a downstream direction (arrows 110) into a web utilization device that, in this example, is a high-volume laser printer 112. The printer 112 includes a rotating image drum 114 that moves generally in conjunction with the movement of the continuous web 102 therethrough. A variety of devices and mechanisms can be used to synchronize the rotation of the drum with the web including using registration controllers that track marks, common gearing of print and drive components, and the like. In general, the web is maintained relatively free of slippage as it impinges the drum so that a highly accurate image transfer is attained. The web can include tractor pin feed holes for a synchronized tractor pin feed mechanism or can be pinless and driven by a drive roller pair 116. A method and apparatus for directing web free of tractor pin feed holes is shown and described in for example U.S. Pat. No. 5,967,394, entitled SYSTEM AND METHOD FOR FEEDING PINLESS WEB TO A UTILIZATION DEVICE, by H. W. Crowley, et al, the teachings of which are expressly incorporated herein by reference. This patent also teaches various tracking mechanisms for maintaining accurate registration of web as it passes through the image transfer device. Such tracking concepts can be used herein. In general, these concepts entail the reading of marks on the web. Such marks (M) are shown, for example, as pre-printed rectangles on each section or page of a continuous web in, for example, FIGS. 4–6. These will be described further below. As used herein, the term "mark" can mean any readable design, printing, or structure on a web, including invisible structures, pin holes, perforations, tractor pin feed holes—or other formations/print disposed at regular, or predictable, intervals on the continuous web.

Downstream of the printer 112 is located a cutter 130. The cutter 130 includes input drive rollers 132 and a cutter blade mechanism 134. The cutter blade mechanism 134 can be any acceptable cutting device including a rotary cutter head, a cross-slicer or a dropping blade (guillotine) cutter head. The printer 112 and cutter 130 are controlled by respective central processing units (CPUs) 140 and 150.

The system includes a splice detector 160. The sensor 160 can be any form of mechanical, optical or sonic sensor capable of detecting a splice between two sections of continuous web. For example, the sensor can comprise an optical detector arranged for detecting preprinted splice indicators in the web or notches/perforations that are placed at splices. Alternatively, the sensor can comprise a sensitive roller or tactile-feedback device that senses an abrupt thickening of the web in the region of the splice. Alternatively, the detector 160 can comprise a camera that transmits images to a user display and/or is interconnected with a pattern-recognizing machine vision system that is trained to recognize the characteristic structures and lines defined by a splice. Machine vision systems and associated software for inspecting webs are commercially available from a variety of sources such as Cognex Corp. of Natick, Mass.

The detector 160 is operatively connected, by appropriate drivers and circuitry, to a controller 170. The controller 170 can comprise a variety of different programmable microprocessor, microcontroller and/or state machine logic units. The controller 170 also receives inputs from a set of mark sensors/detectors 180, 182 and 184 located adjacent the roll stand 106, printer 112 and cutter 130, respectively. As shown, the interconnection can be made via respective CPUs 140 and 150, or the interconnections can be direct. Where sensors are integral with the underlying utilization device (printer or cutter) and are used for other internal tracking functions, typically the signal generated by the sensors is tapped via the respective CPU.

Note that the output of the cutter 130 comprises a series of overlapping sheets 180. These sheets are typically provided in a desired order for further production including binding, offsetting and/or inserting. Further processing devices such as offsetters and separators can be employed to create discrete stacks of sheets with appropriate markers (offset sheets for example) therebetween.

Figure 2:
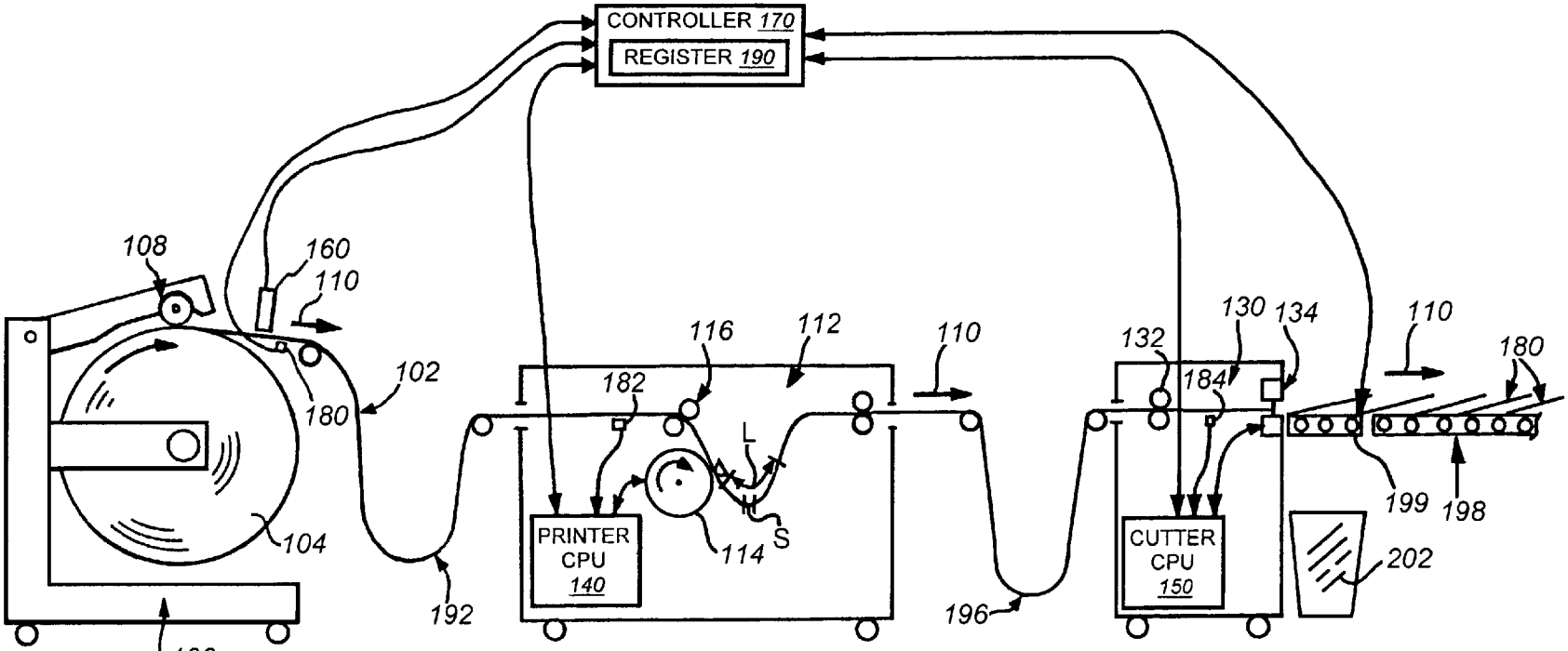
FIG. 2 is a schematic side view of the system of FIG. 1 in which the splice is located adjacent the print engine.
Figure 5:
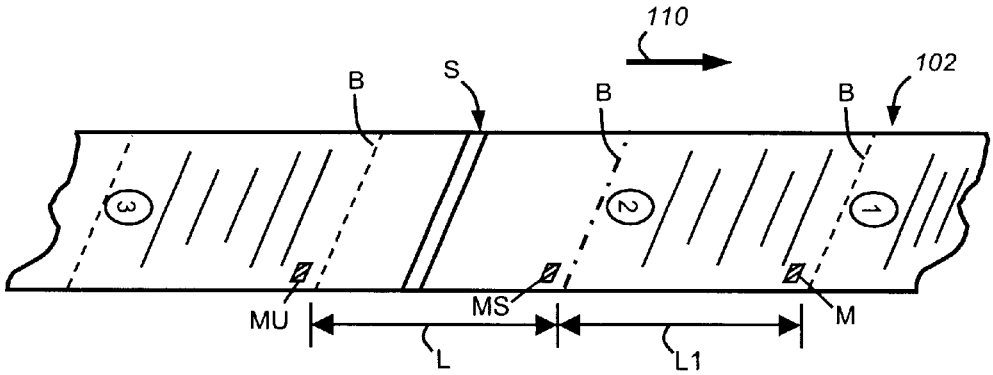
FIG. 5 is a schematic perspective view of the stream of FIG. 4 showing sections having printing thereon with the splice-containing section free of printing.
Figure 6:
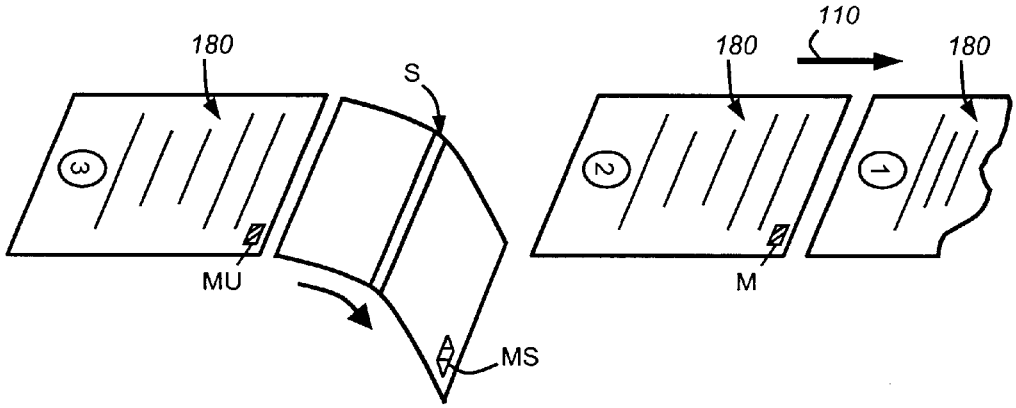
FIG. 6 is a schematic side view of the stream of FIGS. 4 and 5 showing the un-printed splice-containing section being diverted from the stream of cut sections.

With further reference to 4–6, the flow of an exemplary continuous web having a splice (S) is described in further detail. As shown in FIG. 1, when the detector 160 sensors a splice S, it is associated by the controller 170 with a particular location on the web 102. The splice-adjacent mark (MS) is located just upstream of the splice S. Note that a series of dotted lines denote section or page breaks (B) that are used to denote cut lines for pages or sections of web at which the cutter 130 divides the web into individual sheets. The marks M are located just upstream of the section breaks B. The actual location of the marks can be anywhere along the web, as noted above or at the cut lines. It is desirable primarily that they be recognizable by the system as section marks. The mark detector 180 can correlate detection of the splice S or the associated mark (MS) or the upstream adjacent mark (MU) on the next section. When a mark is detected, the controller notes the mark in the register 190. The downstream printer detector 182 also reads marks on the web 102 as they pass thereby. Knowing the number of sections in the web loop 192 spanning between the two detectors 180 and 182 enables the register to track when the mark MS reaches the downstream detector 182 within the printer 112. A distance (L) which, in this embodiment, is a standard section length (similar to the downstream length L1) is denoted around the splice S. In essence, the particular page or section on the continuous web 102 containing the splice is identified. Accordingly, when the controller 170 and printer CPU 140 determine that the splice-containing section has reached the print engine 114, the printer is instructed to cease printing for this section/predetermined web length. When the mark MU is then recognized, the printer is again instructed to begin printing again. At this time, a length L, generally equal to one section, is free of printing as shown in FIGS. 2 and 5.

Figure 3:
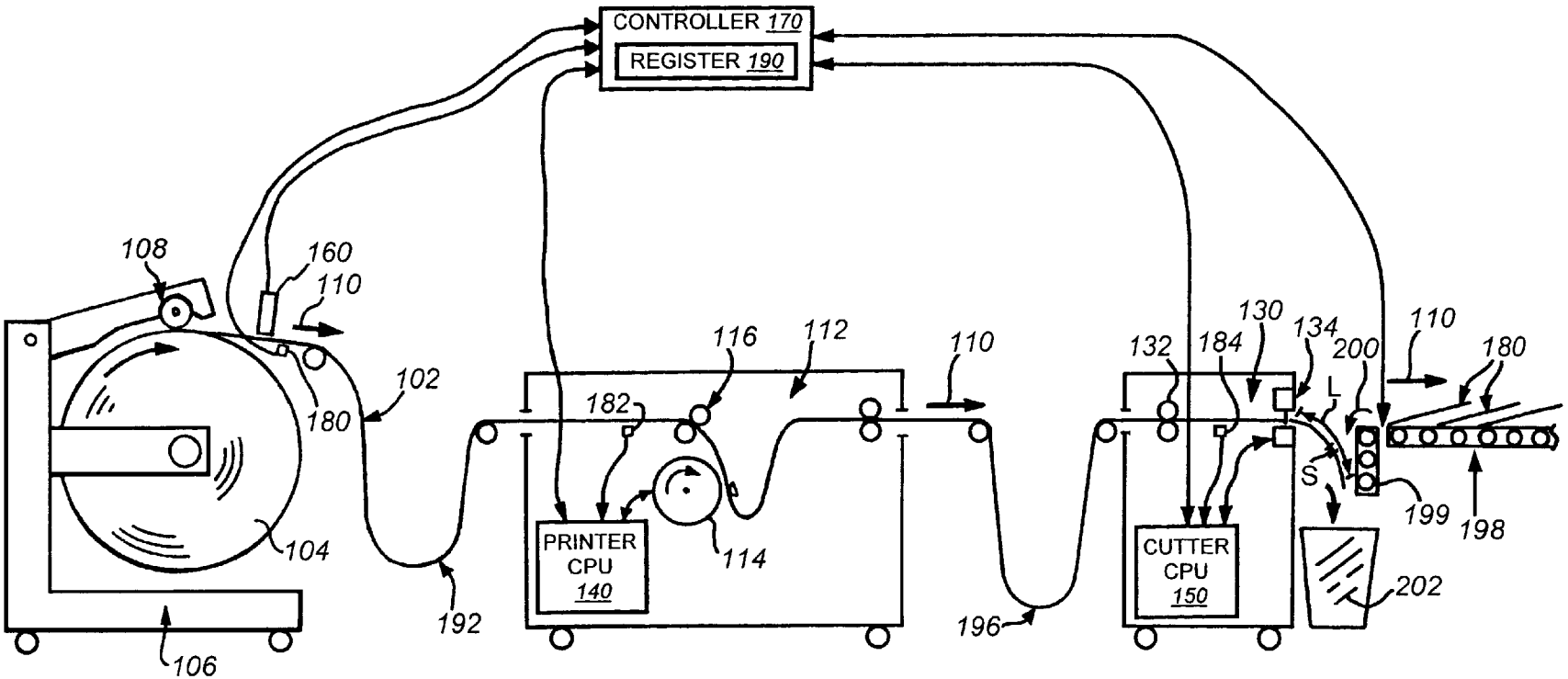
FIG. 3 is a schematic side view of the system of FIG. 1 in which the splice is located downstream of the cutter in a divert location.

As detailed in FIG. 3, the register 190 and the controller 170 continues to track the mark MS as it passes from the printer detector 182 to the cutter detector 184. Again, the length of the free loop 196 (in terms of numbers of marks) between the printer detector 182 and cutter detector 184 is known. Thus, the register 190 tracks marks until the mark MS is presented upstream of the cutter mechanism 134. At this time, the length L containing the splice S is cut, and sent downstream into the overlapping stream 180. However, the output conveyor 198 that transports this stream of sheets 180 includes a divert gate 199 that moves (curved arrow 200) based upon a command from the controller 170 that a splice-containing section has passed therethrough.

A variety of diverter mechanisms can be employed. The diverted sheet, in this embodiment, is directed into a waste bin 202. While a diverter gate that physically removes the sheet from the stream is employed, it is expressly contemplated that "diversion" can include a variety of processes that flag the sheet as containing a splice. For example, an offsetter can be employed to create a lateral (transverse to the downstream direction) offset in the sheet, or it can be marked with special edge printing or notching, punching, and the like. In general, any process that enables relatively quick manual or automatic identification and removal of a splice sheet can be utilized and is considered "diversion" as used herein.

In the present embodiment, once a sheet has been diverted, the gate 199 moves back into an upward position to feed further sheets in a normal stream orientation. The speed of a conveyor 198 can be adjusted so that subsequent output sheets enter the stream in an appropriate overlap relationship with more-downstream sheets. In other words, the conveyor slows while another upstream sheet from the cutter speeds into the flow, thus ensuring that the relative spacing of sheets remains generally uninterrupted.

Figure 7:
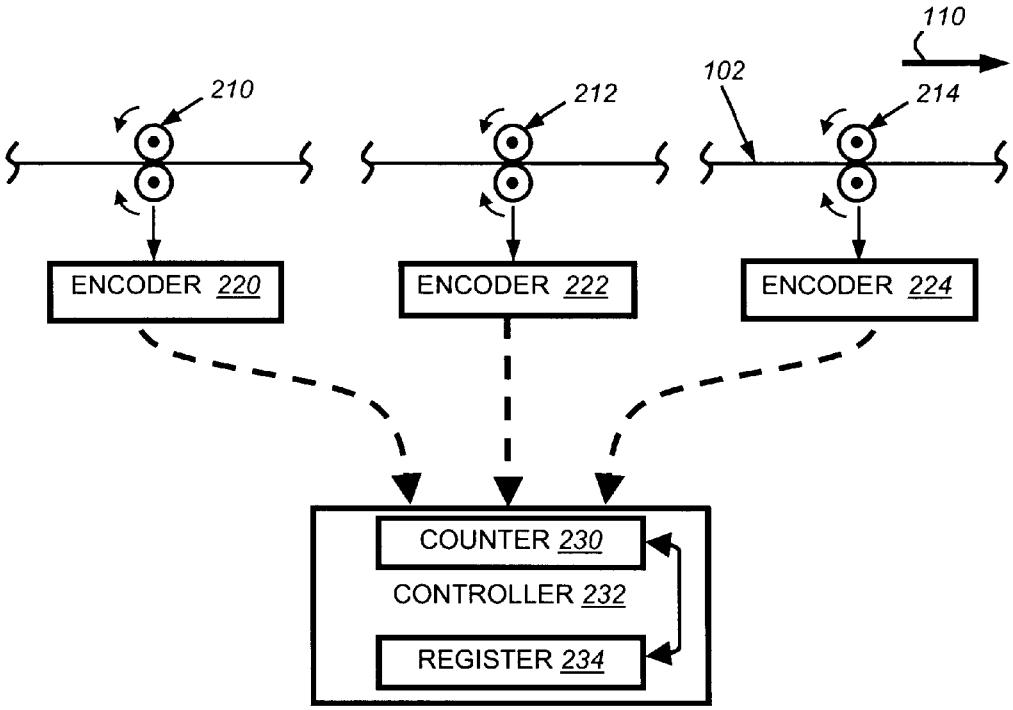
FIG. 7 is a schematic side view of a series of web-movement encoder detectors according to an alternate embodiment of this invention.

While each sheet in this embodiment is cut at a common page spacing, it is expressly contemplated that the mark detectors 180, 182 and 184 can be substituted with length measuring devices such as those shown and described in FIG. 7. The output roll, printer and cutter can include respective encoder wheels 210, 212 and 214 along the web path. The encoder wheels comprise a pair of confronting rollers and an associated encoder circuit 220, 222 and 224. The encoder circuit can count the relative length of web passing there through based upon rotation of the rollers. In one embodiment, the encoder circuitry generates pulses for each discrete length increment (one millimeter or $1/60^{th}$ of an inch, for example) that passes therethrough. It is expressly contemplated that the encoder mechanism can be part of the drive motor and drive member assembly of each respective device. As such, signals therefrom would generally be tapped from the respective device CPU. Based upon a discrete measurement system, pulses are counted by a counter 230 within the controller 232 and the number of pulses are each compared based upon values stored in a register 234. The tracking concepts described herein can be similar to those taught in commonly owned U.S. Pat. No. 5,344,057 entitled SYSTEM METHOD FOR INCORPORATION OF POST-PRODUCTION OPERATIONS TO A WEB OUTPUT FROM AN IMAGE TRANSFER DEVICE by H. W. Crowley et al, the teachings of which are expressly incorporated herein by reference. By accurately counting and tracking discrete lengths of web between each device, the size of the removed splice section L can differ from that of that adjacent section L1. Hence, a smaller overall section (or larger overall section) can be flagged for removal. Nevertheless, as one sheet of paper is relatively inexpensive, simplicity may favor maintaining all sections, including the splice-containing section at the common size of a cut page. Note that the use of variable-length tracking/cutting can be useful where overall page sizes vary within a processing job.

Figure 8:
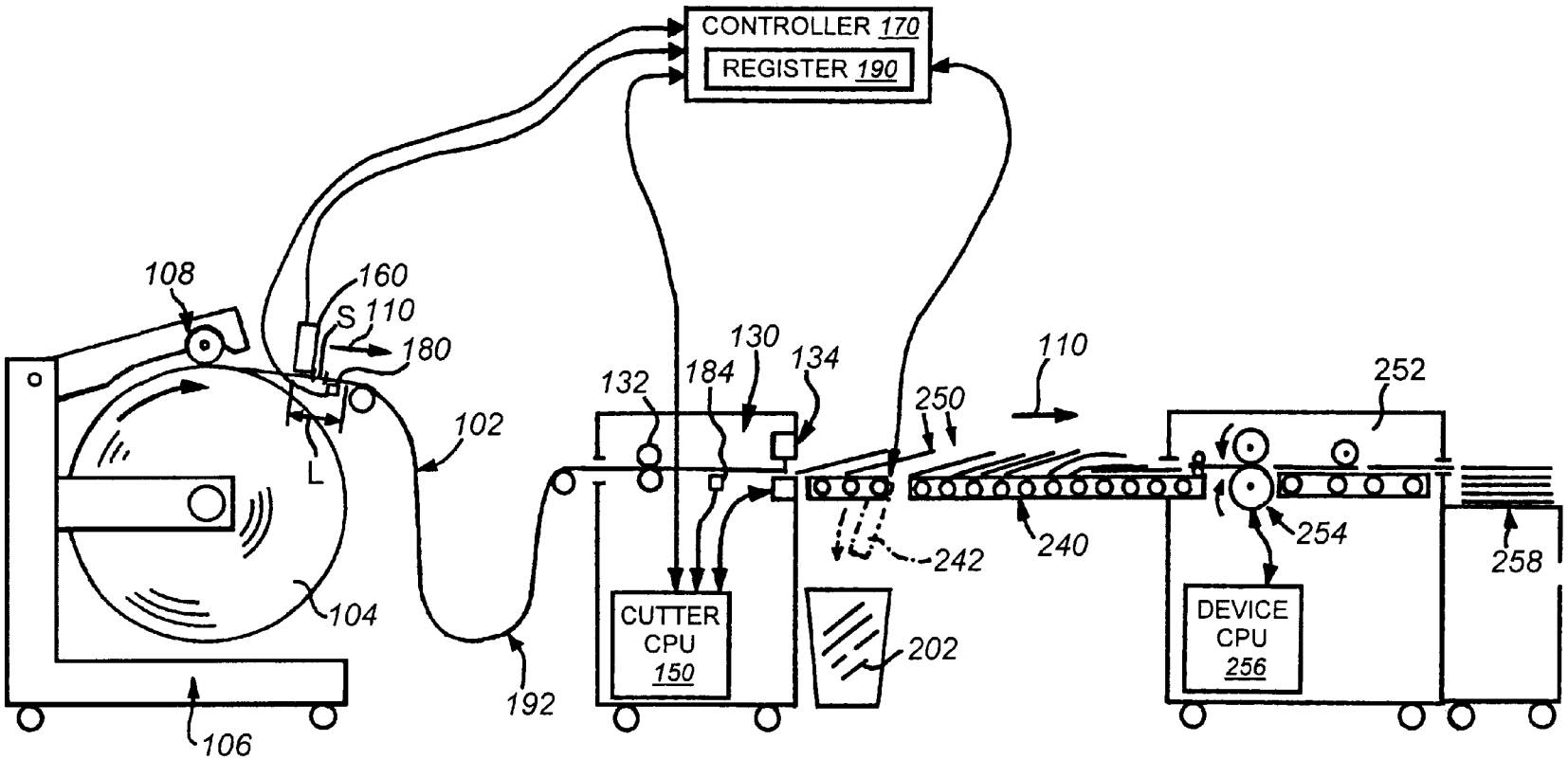
FIG. 8 is a schematic side view of a web processing system having a splice-containing section detection and diversion mechanism according to an alternate embodiment of this invention.

Having described one embodiment of this invention, FIG. 8 now details a slightly different embodiment in which a splice-containing sheet is removed prior to printing or other post-processing operations. In this embodiment, like elements are given like reference numbers. The cutter 130 is positioned directly downstream of the roll stand 106. When a splice-containing section is detected by the detector 160, the tracking detector 180 indicates such to the controller 170 and associated register 190. The output of the cutter detector 184 is correlated with that of the roll stand detector 180, so that the arrival of the splice-containing section is tracked and confirmed at the cutter. When the splice-containing section is cut and directed out of the cutter 130 onto the conveyor 240, the divert gate 242 (shown in an open position in phantom) opens to divert the splice-containing section into the waste bin 202. Other sheets 250 in the stream continue moving in a downstream direction into the utilization device 252. This device 252 can comprise a printer adapted to feed sheets in cut form having a print engine 254 and CPU 256. A stacking area 258 can be provided downstream thereof.

The foregoing has been a detailed description of the invention. Various modifications and additions can be made without departing from the spirit and scope thereof. For example, marks can be located at intervals greater than or less than one section. Mark sensors and length sensors can be combined to more accurately place section breaks. In addition, mark sensors and movement sensors can be used in combination by various devices to assist in controlling registration of pinless feed. Finally, while diversion, as used herein can entail the omission of processing on a splice-containing sheet, it is contemplated that the splice containing sheet can be processed normally, and that diversion can include identifying the splice containing sheet notwithstanding printing or other processes thereon, but producing an additional non-splice containing sheet with the same printing or other processes (e.g. reprocessing the splice-containing sheet on a non-splice containing sheet, and removing the splice-containing sheet). Finally, while the teachings herein are directed specifically to the handling of splices, it is contemplated that other pre-existing imperfections in the web can be detected and diverted according to the teachings of this invention, and therefore, the term "splice" can be defined broadly to include other such imperfections where appropriate. Accordingly, this description is meant to be taken only by way of example, and not to otherwise limit the scope of this invention.

What is claimed is:

1. A system for detecting splices on a continuous web comprising:

a splice detector located adjacent a source of continuous web moving in a downstream direction;

a movement detector located with respect to the source for determining a location of a detected splice;

a cutter for cutting a predetermined section of web containing the splice;

a cutter movement detector for measuring web movement through the cutter;

a controller for coordinating each of the movement detector and the cutter movement detector so that the predetermined section of web containing the splice can be located when it enters the cutter; and a diversion mechanism for enabling removal of the cut section containing the splice.

2. The system as set forth in claim 1 wherein the controller is interconnected with a web utilization device located upstream of the cutter, the controller being constructed and arranged to locate the section of the web containing the splice and perform a utilization device process originally to be performed at the section containing the spice on another web section free of the splice.

3. The system as set forth in claim 2 wherein the utilization device comprises a printer for printing on the continuous web, and the controller is constructed and arranged to cause the section containing the splice to be free of printing and to apply print originally to be printed on the section containing the splice on an adjacent upstream section.

4. The system as set forth in claim 2 wherein the web section free of the splice at which the utilization device process is performed is a section adjacent the section of the web containing the splice.

5. The system as set forth in claim 2 wherein the utilization device includes a utilization device movement detector for measuring movement of web through the utilization device, and the controller includes a register for tracking sheets moving between the movement detector and the cutter movement detector.

6. The system as set forth in claim 1 wherein the diversion mechanism comprises a divert gate that directs the cut section containing the splice away from other sheets cut from the web by the cutter.

7. The system as set forth in claim 1 wherein the cutter is located downstream of the source and upstream of a utilization device, the utilization device performing a utilization device operation to sheets cut by the cutter from the web, and the diversion mechanism being located so as to divert the cut section so as to be unprocessed by the utilization device.

8. The system as set forth in claim 7 wherein the diversion mechanism comprises a divert gate that directs the cut section containing the splice away from other sheets cut from the web by the cutter.

9. The system as set forth in claim 1 wherein the source of continuous web includes a roll of continuous web mounted on a driven roll stand.

10. A method for detecting splices on a continuous web comprising:

detecting splices in the web with a splice detector located adjacent a source of continuous web moving in a downstream direction;

determining, with a movement detector located with respect to the source, a location of a detected splice;

cutting, with a cutter, a predetermined section of web containing the splice;

measuring, with a cutter movement detector, web movement through the cutter;

coordinating, with a controller, each of the movement detector and the cutter movement detector so that the predetermined section of web containing the splice can be located when it enters the cutter; and diverting, with a diversion mechanism the cut section containing the splice.

11. The method as set forth in claim 10 wherein the controller is interconnected with a web utilization device located upstream of the cutter, and further comprising locating, with the controller, the section of the web containing the splice and performing a utilization device process originally to be performed at the section containing the spice on another web section free of the splice.

12. The method as set forth in claim 11 wherein the utilization device comprises a printer for printing on the continuous web, and the step of performing includes operating the printer so that the section containing the splice is free of printing and applying print originally to be printed on the section containing the splice on an adjacent upstream section.

13. The method as set forth in claim 11 wherein the web section free of the splice at which the utilization device process is performed is a section adjacent the section of the web containing the splice.

14. The method as set forth in claim 13 wherein the utilization device includes a utilization device movement detector, and further comprising measuring movement of web through the utilization device, and registering, with a register, and thereby tracking sheets moving between the movement detector and the cutter movement detector.

15. The method as set forth in claim 10 wherein the step of diverting includes directing, with a divert gate, the cut section containing the splice away from other sheets cut from the web by the cutter.

16. The method as set forth in claim 10 further comprising positioning the cutter downstream of the source and upstream of a utilization device, performing, with the utilization device, a utilization device operation to sheets cut by the cutter from the web, and wherein the step of diverting includes diverting the cut section so as to be unprocessed by the utilization device.

17. The method as set forth in claim 16 wherein the step of diverting includes directing, with a divert gate, the cut section containing the splice away from other sheets cut from the web by the cutter.

18. The method as set forth in claim 10 further comprising providing the continuous web from a roll of continuous web mounted on a driven roll stand.

* * * * *